United States Patent [19]

McDonald et al.

[11] Patent Number: 4,531,514

[45] Date of Patent: Jul. 30, 1985

[54] ORTHOPEDIC TRACTION APPARATUS

[76] Inventors: J. Ralph McDonald, 2156 Ridgewood Way, Bountiful, Utah 84010; Philip S. McDonald, 565 6th Ave., Salt Lake City, Utah 84103

[21] Appl. No.: 503,249

[22] Filed: Jun. 10, 1983

[51] Int. Cl.[3] ..... A61H 1/02

[52] U.S. Cl. ..... 128/75; 128/69; 272/61; 272/143; 272/144

[58] Field of Search ..... 128/75, 69, 71; 272/116, 120, 121, 143, 144

[56] References Cited

U.S. PATENT DOCUMENTS 806,565 12/1905 Percy ..... 128/75
3,593,708 7/1971 Steele ..... 272/61 X
3,659,594 5/1972 Schwab ..... 128/75 X
3,872,860 3/1975 Noblitt ..... 128/75
4,362,151 12/1982 Cottrell ..... 128/75

*Primary Examiner*—Richard J. Apley
*Assistant Examiner*—Alan Cannon
*Attorney, Agent, or Firm*—Thorpe, North & Western

[57] ABSTRACT

An orthopedic traction apparatus for providing traction and flexion to the lumbar spine has in combination a trapeze bar connected to a double-pull traction belt by means of a pair of lateral suspension straps to provide stability. The trapeze bar or T-bar is suspended from a block-and-tackle to provide means for hoisting the user off the floor when the user is wearing the belt and has his legs over the trapeze bar.

4 Claims, 6 Drawing Figures

ORTHOPEDIC TRACTION APPARATUS

BACKGROUND OF THE INVENTION

Low back disorders of the spine have been a cause of pain and discomfort since the dawn of recorded history. These disorders have been associated with the disease and displacement of the intervertebral disc, spinal stenosis, disc degeneration and nerve entrapment syndromes related to narrowing or loss of the intervertebral space. Other conditions causing lower back pain have included acute strains and sprains, facet syndromes, muscle spasms, vertebrae alignment problems and stretched or hypersensitive sciatic nerves. All of these problems and others have been the subject of attempts to ease or eliminate lower back pain.

One of the most common forms of treatment of lower back pain has traditionally been the use of traction provided by a wide variety of devices. Most of these forms of traction are known to be ineffective because of failure to produce enough actual distraction on the spiral joint itself, and by ineffective positioning of the back.

Specialist in the field of back care have recognized that there is a need to provide adequate flexing of the lumbar spinal joints to open up the posterior spinal canal and neuroforamina. This, in turn, relieves the compression of the intervertebral discs and opens up the posterior spinal canal, which increases the room for the spinal cord and nerve roots. Medical studies have shown that disc degeneration and collapse occurs because of the constant compression caused by body weight. Proper traction allows reexpansion of the disc by the interstitial fluid. With knees and hips flexed the sciatic nerve is relaxed, so that in conditions where relief and stretch or tension on the nerve is desirable, the flexion of the hips and knees may be necessary.

It is therefore an objective of this invention to provide an apparatus to flex and distract the lower lumbar spinal region to relieve compression on the spinal discs and open the posterior spinal canal.

It is also an objective of the invention to provide means for articulation of the spine while in traction.

An additional objective is to facilitate stretching of soft tissues surrounding the lumbar spine in a position which is favorable for sensitive sciatic nerves.

A further objective is to provide a device to gradually increase flexion and traction as the user progresses in his ability to reverse the compressive forces on the lumbar spine and pelvic areas.

SUMMARY OF THE INVENTION

The orthopedic traction apparatus of the invention includes three major components working in combination with each other: a trapeze or T-bar, a double-pull pelvic traction belt and hoisting means. The trapeze provides a padded leg rest and is attached both to the double-pull pelvic traction belt worn by the user and to the hoisting means, such as a block and tackle or the like, attached to a tripod or the ceiling of a room.

In use, the patient places the double-pull pelvic traction belt about the hips or pelvic region of the body, hooks both attached straps on either side of the belt to the trapeze or T-bar. The knees of the patient are placed over the bar and the bar is raised with the hoisting means. As the trapeze bar is raised, the patient's knees are first raised to produce flexion, then the pelvis is raised by apply traction to relieve compression on the vertebral discs. The double-pull traction belt affords stability while permitting the user to control the motions of the body and to gently apply rotational motion or articulation to the spine according to the requirements of the user when used in conjunction with the trapeze or T-bar. This type of combined traction and articulation of the spine have not been possible heretofore with known devices.

THE DRAWINGS

Preferred embodiments of the invention are illustrated in the accompanying drawings, in which:

FIG. 1 is a perspective view of one embodiment of the invention showing hoisting means employed with a four-legged support device;

FIG. 2, a second embodiment of the invention showing hoisting means employed with a block-and-tackel attached to a ceiling;

FIG. 3, a front elevational view of a trapeze bar of the invention;

FIG. 4, a side elevational view of the trapeze bar taken along Line 4—4 of FIG. 3;

FIG. 5, a side elevational section of the trapeze bar taken along Line 5—5 of FIG. 3; and FIG. 6, a front elevational view of a T-bar of the invention used as an alternative to the trapeze bar shown in FIG. 3.

DETAILED DESCRIPTION OF THE ILLUSTRATED EMBODIMENTS

Figure 1:
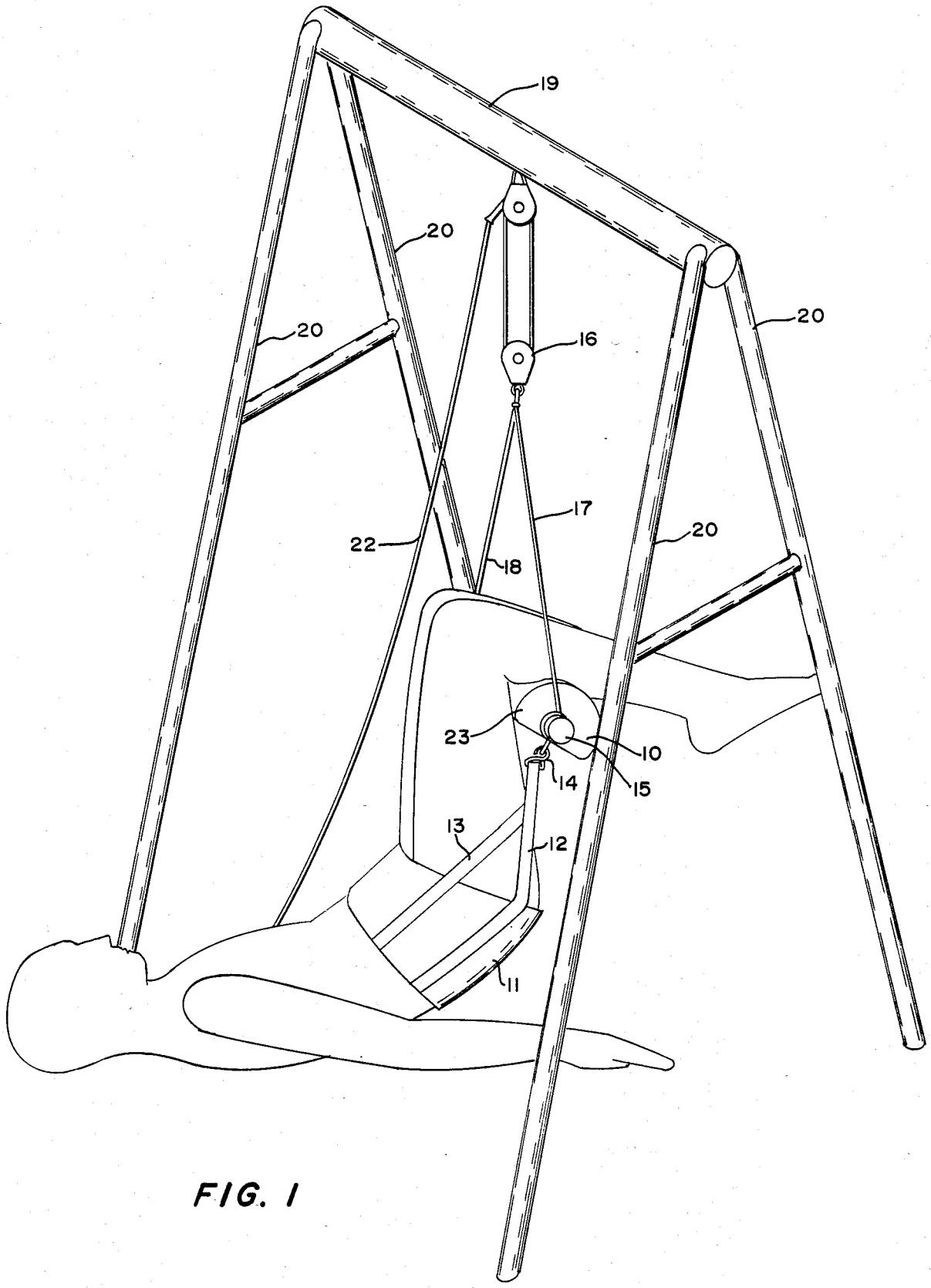
Figure 2:
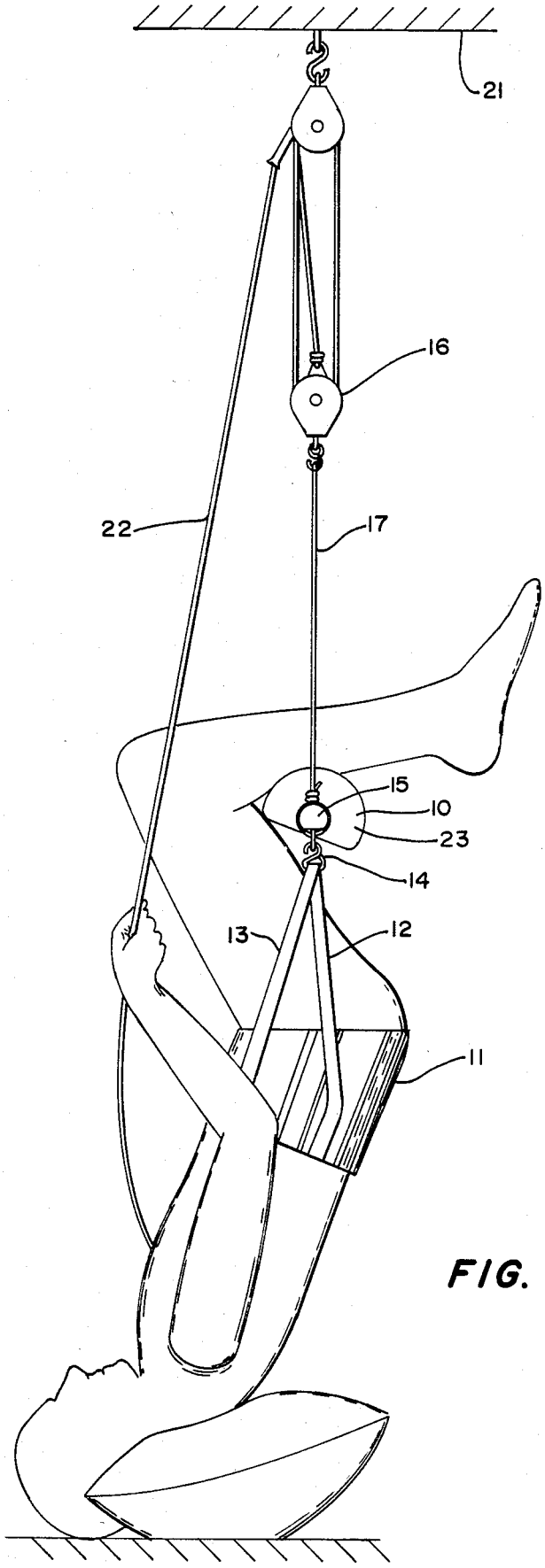
Figure 3:
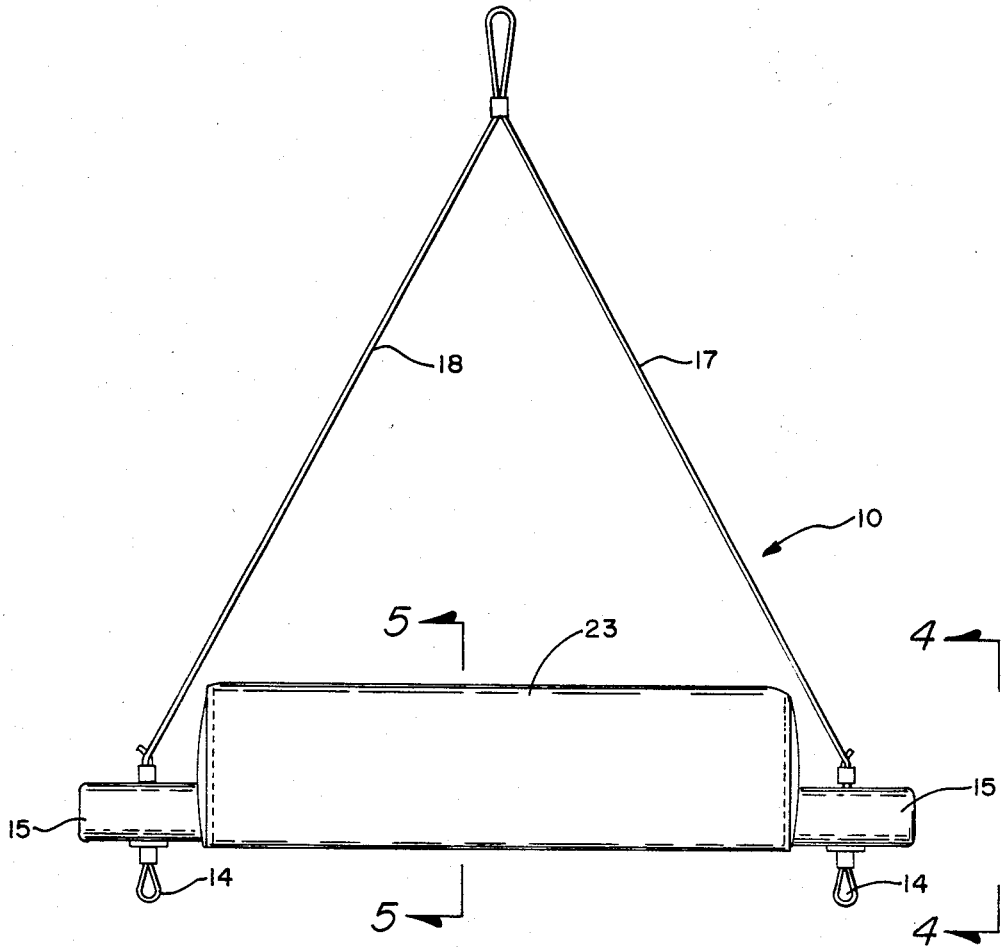
Figure 4:
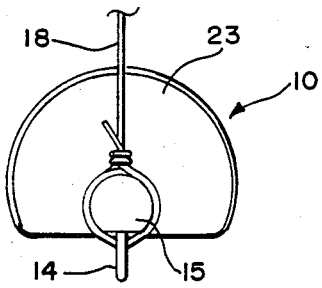

As shown in FIGS. 1 and 2, the apparatus of the invention has a padded trapeze bar 10 adapted to be placed under the knees of the user, as shown in the drawings. A double-pull pelvic traction belt 11 is suspended from trapeze bar 10 by means of two pairs of support straps 12, 13 extending respectively from either lateral side of belt 11. In this embodiment, the straps 12, 13 are attached to hooks 14 extending downwardly from either end of lateral support rod 15 of bar 10, shown in further detail in FIGS. 3 and 4. The purpose of the double-pull or double-sided traction belt 11 is to provide a secure grip on the user's pelvis and waist by distributing the pull throughout the belt. Belt 11 also provides stability to the user and prevents unwanted rotational twisting of the body as it is hoisted. Moreover, the tractive force is delivered to both sides of the pelvis, not just the center as in the "single-pull" style belt. The use of belt 11 in conjunction with bar 10 provides not only tractive force to the pelvis but support for the legs of the user to increase stability.

Trapeze bar 10 is in turn suspended from a block-and-tackle 16 by a pair of ropes or chain 17, 18 extending downwardly from block-and-tackle 16 to either respective end of lateral support bar 15. Block-and-tackle 16 are suspended either from a cross bar 19 supported by four legs 20, as shown in FIG. 1; or from a cross-beam or ceiling 21, as shown in FIG. 2. Block-and-tackle 16 are operated by the user by means of a rope 22 in both instances, so that the user can adjust and control the height to which the user is suspended. This permits the user to raise himself as high as necessary or desirable to raise the pelvis off the floor, not just the buttocks. By controlling the height to which the pelvis is raised off the floor, the user determines the degree of flex and traction applied to the lumbar region of the spine. This is not available with other tractive devices, most of which only lift the buttocks and not the pelvis, and are athletic or gymnastic in nature, making use by those users in pain virtually impossible.

Figure 5:
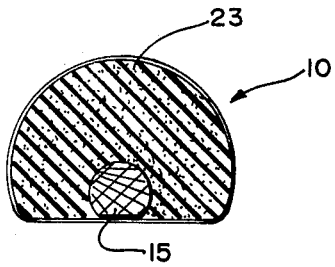

As shown in FIG. 5 in detail, trapeze bar has a sufficient amount of padding material 23 around support bar 15 both to provide comfort to the legs and to form a large enough object to support both the thighs and calves of the legs.

Figure 6:
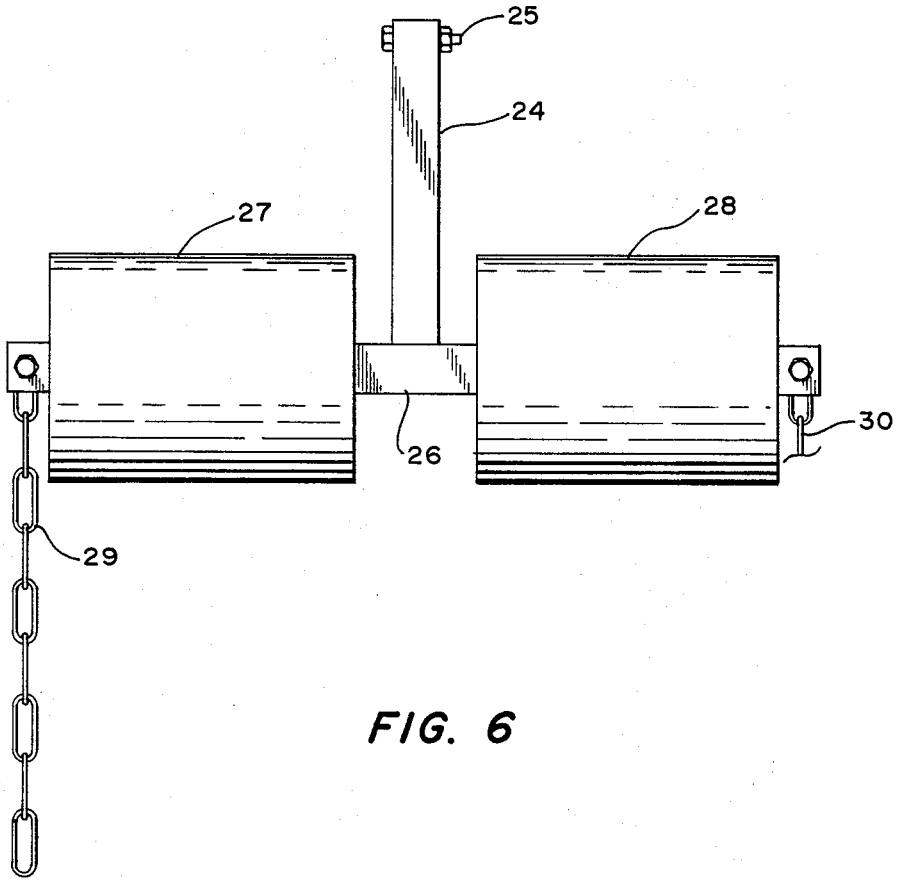

As shown in FIG. 6, an alternative to the trapeze bar 10 is illustrated in the form of a T-bar 24 for attachment by bolt 25 to a block-and-tackle 16. T-bar 24 is attached at its other end to lateral support bar 26 at the center thereof. T-bar 24 provides rigidity between lateral cross-bar 26 and block-and-tackle 16 for control of rotational twisting of the body during hoisting. A pair of padded leg rests 27, 28 are provided along either side of cross-bar 26 to permit the user's legs to rest thereupon. Chains 29, 30 extend downwardly from cross-bar 26 for attachment to a traction belt of the type shown in FIGS. 1 and 2.

While this invention has been illustrated and described with respect to specific preferred embodiments, it should be understood that substantial equivalents recognized by those skilled in the art are included herein, and the scope of protection is defined by the appended claims.

We claim:

1. Orthopedic traction apparatus comprising in combination:

a trapeze bar means for accomodating the legs of a user and having attachment means at either end thereof;

a traction pelvic belt means having suspending strap means extending upwardly from both respective sides of said belt means for attachment to said attachment means at the ends of said trapeze bar such that when in use said trapeze bar will be elevated above said suspending strap means;

block and tackle means attached to said trapeze bar means for hoisting said trapeze bar means, traction pelvic belt means and a user from a surface such that when in use said trapeze bar means will be elevated and positioned directly below said block and tackle means; and means for suspending said block and tackle means from an elevated support means such that said block and tackle means and trapeze bar means will be at an elevated position above the torso of said user when in use allowing said user's legs, buttocks and pelvis to be raised by any desired position for traction and articulation of the spine.

2. Traction apparatus means as set forth in claim 1, wherein said elevated support means is a portable support bar positioned above said block and tackle means and supported by a plurality of leg means.

3. Traction apparatus as set forth in claim 1, including padding material on said trapeze bar.

4. Traction apparatus as set forth in claim 1, wherein said trapeze bar means comprises a T-bar.

* * * * *